US011660242B2

(12) United States Patent
Miller

(10) Patent No.: US 11,660,242 B2
(45) Date of Patent: May 30, 2023

(54) PORTABLE PATIENT TURNING DEVICE

(71) Applicant: Morgan Leigh Miller, Spencer, IN (US)

(72) Inventor: Morgan Leigh Miller, Spencer, IN (US)

( * ) Notice: Subject to any disclaimer, the term of this patent is extended or adjusted under 35 U.S.C. 154(b) by 0 days.

(21) Appl. No.: 16/903,786

(22) Filed: Jun. 17, 2020

(65) Prior Publication Data

US 2020/0390625 A1 Dec. 17, 2020

Related U.S. Application Data

(60) Provisional application No. 62/862,377, filed on Jun. 17, 2019.

(51) Int. Cl.

| | |
|---|---|
| ***A61G 7/057*** | (2006.01) |
| ***A61G 7/10*** | (2006.01) |
| ***A47G 9/10*** | (2006.01) |

(52) U.S. Cl.

CPC ..... *A61G 7/05776* (2013.01); *A47G 9/10* (2013.01); *A61G 7/05746* (2013.01); *A61G 7/109* (2013.01); *A61G 7/1084* (2013.01); *A61G 7/1086* (2013.01); *A61G 7/1098* (2013.01); *A47G 2009/1018* (2013.01); *A61G 2200/327* (2013.01); *A61G 2203/34* (2013.01)

(58) Field of Classification Search

CPC .. A61G 7/05776; A61G 7/746; A61G 7/1084; A61G 7/109; A61G 7/1098; A61G 2200/327; A61G 2203/34

See application file for complete search history.

(56) References Cited

U.S. PATENT DOCUMENTS

| | | | | |
|---|---|---|---|---|
| 3,477,071 | A | 11/1969 | Emerson | |
| 3,775,781 | A | 12/1973 | Bruno et al. | |
| 4,977,629 | A | 12/1990 | Jones | |
| 5,092,007 | A | 3/1992 | Hasty | |
| 5,103,518 | A * | 4/1992 | Gilroy | A61G 7/05776 5/713 |
| 5,375,273 | A | 12/1994 | Bodine, Jr. et al. | |
| 5,394,577 | A | 3/1995 | James | |
| 6,182,316 | B1 * | 2/2001 | Thomas | A47C 27/086 5/722 |

(Continued)

FOREIGN PATENT DOCUMENTS

| | | |
|---|---|---|
| EP | 2279719 | 2/2011 |
| GB | 2449318 | 11/2008 |

*Primary Examiner* — David R Hare
*Assistant Examiner* — Adam C Ortiz
(74) *Attorney, Agent, or Firm* — C. Richard Martin; Martin IP Law Group, PC

(57) ABSTRACT

A portable patient turning device is provided comprising an inflatable mattress cover having a planar surface configured to substantially cover the surface of a bed, and a control unit connected to the inflatable mattress cover by one or more air hoses. The inflatable mattress cover further comprises a first inflatable chamber proximate to and extending along a left edge of the planar surface, a second inflatable chamber proximate to and extending along a right edge of the planar surface, and a spine cushion positioned between the first inflatable chamber and the second inflatable chamber and extending along a middle portion of the planar surface for at least a portion of the length of the first inflatable chamber and second inflatable chamber.

19 Claims, 3 Drawing Sheets

(56) References Cited

U.S. PATENT DOCUMENTS

| | | | | |
|---|---|---|---|---|
| 6,370,716 | B1 * | 4/2002 | Wilkinson | A61G 5/1043 297/314 |
| 6,499,167 | B1 | 12/2002 | Ellis et al. | |
| 6,643,873 | B2 | 11/2003 | Heimbrock et al. | |
| 7,080,422 | B2 | 7/2006 | Ben-Levi | |
| 7,111,348 | B2 * | 9/2006 | Ellis | A61G 7/05769 5/713 |
| 7,712,171 | B2 * | 5/2010 | Butler | A61G 7/05784 5/715 |
| 8,196,240 | B2 | 6/2012 | Meyer et al. | |
| 8,620,477 | B2 | 12/2013 | Skinner et al. | |
| 8,832,884 | B2 | 9/2014 | Stacy et al. | |
| 9,655,457 | B2 | 5/2017 | Meyer et al. | |
| 2003/0159219 | A1 * | 8/2003 | Harrison | A61G 7/05769 5/713 |
| 2005/0166328 | A1 | 8/2005 | Ben-Levi | |
| 2005/0262638 | A1 * | 12/2005 | Libunao | A61G 7/001 5/736 |
| 2008/0040860 | A1 | 2/2008 | Price et al. | |
| 2011/0119829 | A1 * | 5/2011 | Skripps | A61B 6/0421 5/601 |
| 2014/0237722 | A1 * | 8/2014 | Gibson | A61G 7/05776 5/600 |
| 2015/0101126 | A1 * | 4/2015 | Reiners | A47C 27/10 5/715 |
| 2020/0155396 | A1 * | 5/2020 | Popitz | A47G 9/109 |
| 2021/0369522 | A1 * | 12/2021 | Nahavandi | A61G 7/072 |

* cited by examiner

PORTABLE PATIENT TURNING DEVICE

BACKGROUND OF THE INVENTION

Field of the Invention

This disclosure relates generally to medical devices, and more particularly to portable devices for turning patients.

Description of the Related Art

Pressure sores (also referred to as bed sores, pressure ulcers, or decubitus ulcers) can cause serious complications in hospital patients, particularly in immobile patients. Pressure sores can develop when a patient remains in the same position for a prolonged period of time. In addition to causing considerable pain to the patient, pressure sores are difficult and costly to treat, as the pressure sores can become infected and may even lead to the death of the patient. In most cases, however, pressure sores are preventable if the immobile patient is repositioned or turned at regular intervals.

Presently, patients are typically manually turned by nurses, hospital techs, or other care providers at regular intervals to avoid the development of pressure sores. When a patient needs to be turned, typically at least two people are required. One person will help the patient turn to either the right or left side and then hold the patient in that position while the other person puts a pillow under the patient's side. The turning movement and the pillow help relieve some of the pressure off one side to prevent a pressure sore from developing. The turning procedure is then repeated to the opposite side to relieve the pressure on that side after a set period of time so that pressure sores do not develop on the first side.

While manually turning the patient, however, requires reminders so that the hospital staff or care giver does not forget to turn the patient. Moreover, the manual turning is very labor intensive for hospital staff. In particular, significant stress is put on the back of the person tasked with lifting the patient while the pillow is placed under the patient, particularly if the patient is heavier. The hospital staff may even be required to take time off after turning multiple patients in a day due to the excessive stress on the staff causing back injuries. In addition, hospitals that are understaffed may not have enough staff to turn patients at the required intervals.

Furthermore, some patients refuse to allow hospital staff to turn them because the patient does not want to be awakened, which can lead to the patient getting pressure sores. As a result, manually turning patients causes injuries to hospital staff and lost work time, and is not completely effective.

Other conventional beds, for example bariatric or rotational beds, have motors that move parts of the bed to at least partially turn a patient. Such beds, however, are very expensive, often prohibitively so for home care, and are not easily movable to different locations. Hospitals that have bariatric beds typically only have a limited number due to the high cost of such beds, and therefore the patient must be transferred to the room in which the bed is located, if one is available.

Some other mattresses include gel or air "waffle" arrangements that can vary the pressure points on an immobile patient. However, such mattresses do not turn the patient and do not therefore provide a suitable solution to pressure sores.

Moreover, these arrangements are typically only capable of a single use and are thereafter discarded.

What is needed therefore is a system for turning patients that is reliable, affordable, portable, and/or not labor intensive.

SUMMARY OF THE INVENTION

It is therefore an object of the present invention to provide a system for turning patients that can be easily transported from place to place.

It is also an object of the invention to provide a patient turning device that is reliable, affordable and not labor intensive.

The present invention meets these objects by providing a portable patient turning device that includes an inflatable mattress cover coupled to a control unit by one or more air hoses.

According to one presently preferred embodiment of the invention, there is provided a portable patient turning device comprising an inflatable mattress cover having a planar surface configured to substantially cover the surface of a bed, and a control unit connected to the inflatable mattress cover by one or more air hoses. The inflatable mattress cover further comprises a first inflatable chamber proximate to and extending along a left edge of the planar surface, a second inflatable chamber proximate to and extending along a right edge of the planar surface, and a spine cushion positioned between the first inflatable chamber and the second inflatable chamber and extending along a middle portion of the planar surface for at least a portion of the length of the first inflatable chamber and second inflatable chamber.

The control unit may be connected to the first inflatable chamber by a first air hose and to the second inflatable chamber by a second air hose. The first inflatable chamber and the second inflatable chamber may be each divided into a plurality of subchambers. The plurality of subchambers may include a left leg subchamber and a right leg subchamber extending along a lower region of the inflatable mattress cover. A leg barrier chamber may be positioned between and extending the length of the left and right leg subchambers, such that the leg barrier chamber projects a height above the planar surface that exceeds the height of the left and right leg subchambers. The leg barrier chamber may further comprise a left leg barrier chamber and a separate right leg barrier chamber. One or more creases may be located in a central region of each of said left and right leg subchambers in a patient's knee region.

The mattress cover may further comprise a crease extending from the right edge of the planar surface to the left edge of the planar surface between and upper edge of the right and left leg subchambers and a lower edge of one or more upper right and left inflatable chambers. The plurality of subchambers may further include a plurality of left upper subchambers and a plurality of right upper subchambers extending along an upper region of the inflatable mattress cover. The plurality of left and right upper subchambers may each comprises a first upper subchamber in a patient's shoulder and arm region, a second upper subchamber in the patient's lower torso and hip region, and a third upper subchamber in the patient's thigh region.

A left foot cushion and a right foot cushion may be located at the bottom of the mattress cover in a patient's foot region. The left foot cushion and the right foot cushion may be larger than the plurality of subchambers.

The portable patient turning device may further include a head pillow proximate to a top edge of the planar surface in a patient's head region. The head pillow may be filled with a soft material selected from the group consisting of latex, memory foam, feather, polyester, and gel. The head pillow may further include an indented region in a central region of the upper surface.

The mattress cover may further include a plurality of internal air hoses and valves positioned between the plurality of subchambers for separately and independently delivering air to each individual subchamber for selective inflation and deflation. Further, at least one pressure sensor may be located in the mattress cover. A plurality of handles may be provided along the left edge of the mattress cover and a plurality of handles along the right edge of the mattress cover.

These and other objects, features and advantages of the present invention will become apparent from a review of the following drawings and detailed description of the preferred embodiments of the invention.

DETAILED DESCRIPTION OF THE INVENTION

For the purposes of promoting an understanding of the principles of the embodiments described herein, reference is now made to the drawings and descriptions in the following written specification. No limitation to the scope of the subject matter is intended by the references. This disclosure also includes any alterations and modifications to the illustrated embodiments and includes further applications of the principles of the described embodiments as would normally occur to one skilled in the art to which this document pertains.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

The terms "comprising," "including," "having," and the like, as used with respect to embodiments of the disclosure, are synonymous. As used herein, the term "approximately" refers to values that are within ±10% of the reference value. As used herein, the term "patient" refers to a person receiving treatment on or by the patient turning device. The patient may be, for example, a hospital or nursing home patient, or a user who has the patient turning device at his or her home for convenience. As used herein, the term "caregiver" refers to hospital staff, for example nurses, technicians, or doctors, in addition to home caregivers, for example home care nurses, family members, or other people caring for a patient, and also to a patient who may be caring for himself or herself.

Figure 1:
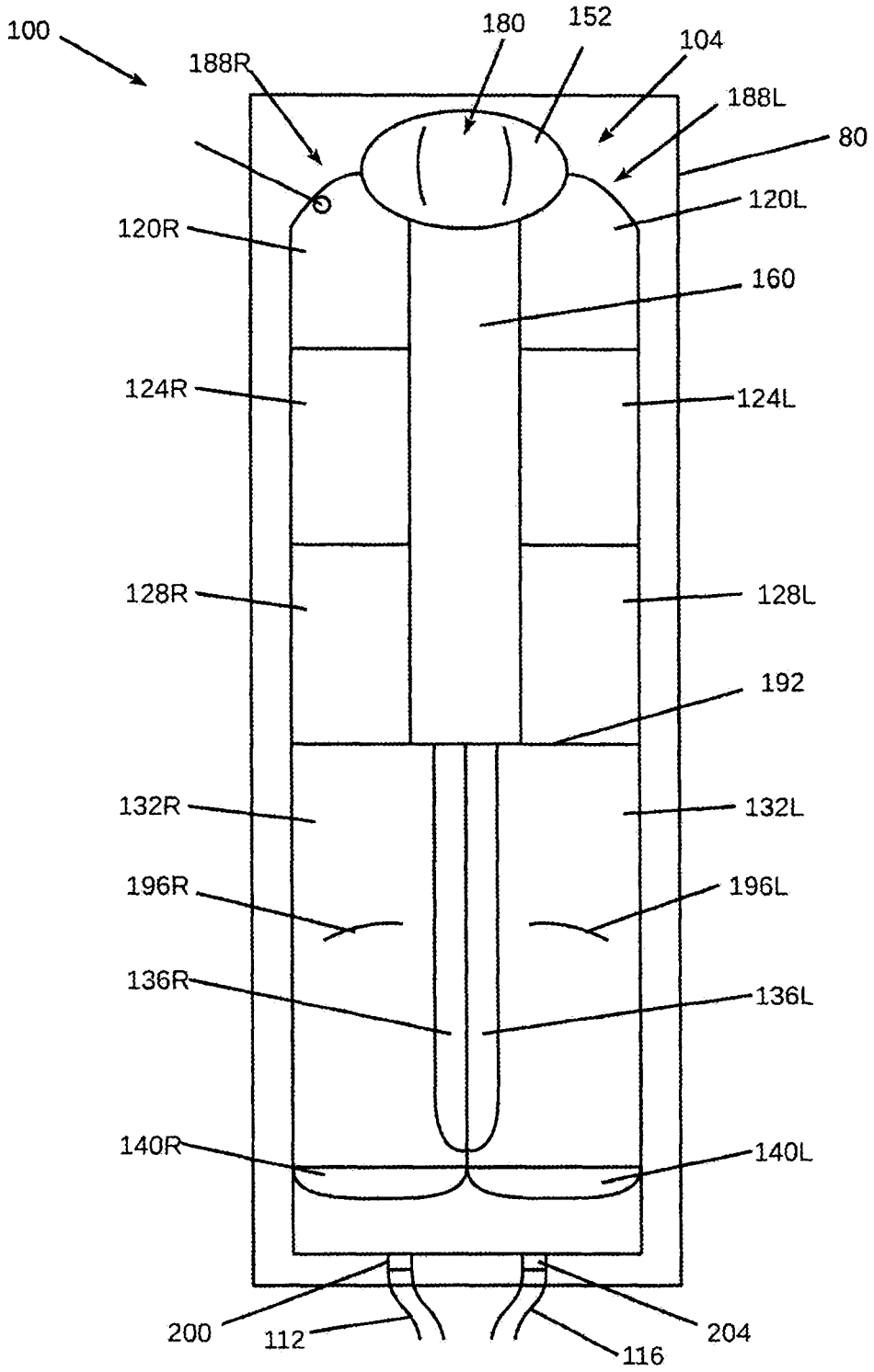
FIG. 1 is a top plan view of an inflatable mattress pad of a patient turning device according to a first preferred embodiment of the invention.
Figure 2:
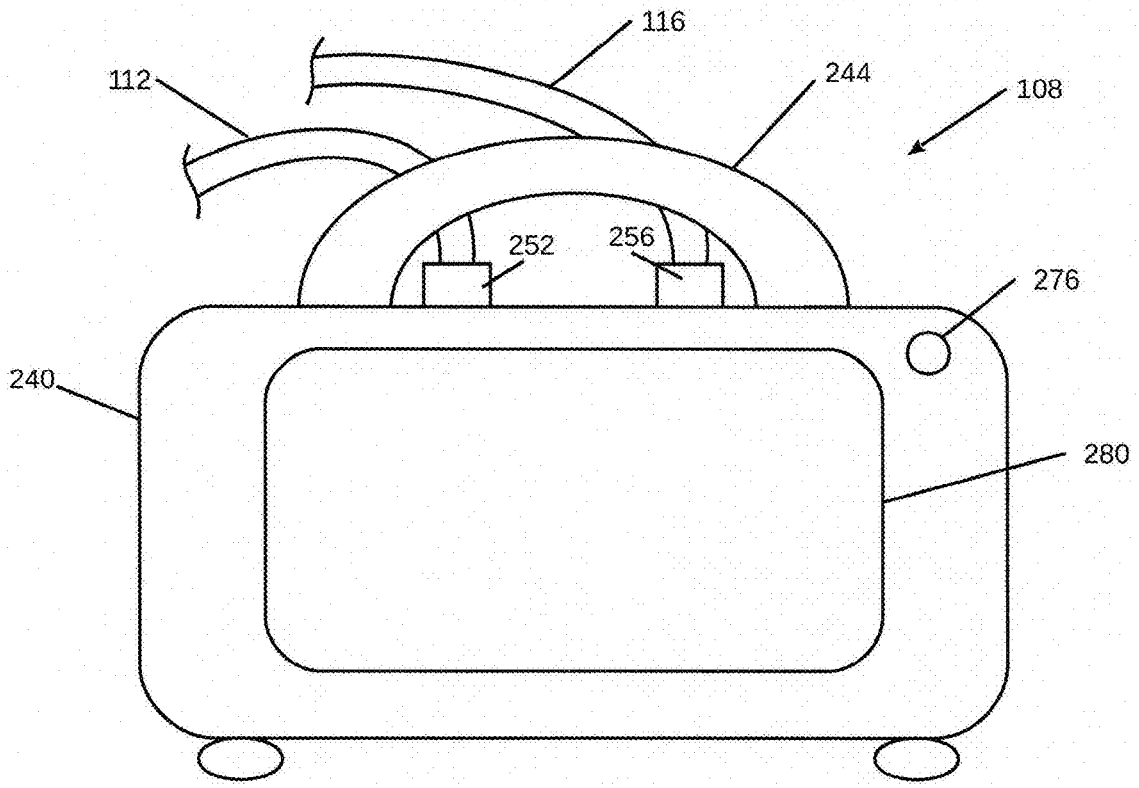
FIG. 2 is a side elevational view of a control unit of the patient turning device of FIG. 1.

FIGS. 1 and 2 illustrate a portable patient turning device 100 that operates to automatically turn a patient. The patient turning device 100 includes an inflatable mattress cover 104 (FIG. 1) and a control unit 108 (FIG. 2), connected to one another by air hoses 112, 116.

FIG. 1 schematically depicts a top view of the inflatable mattress cover 104 positioned on a mattress 80, the inflatable mattress cover 104 includes a plurality of right side chambers 120R, 124R, 128R, 132R, 136R, and 140R, and a plurality of left side chambers 120L, 124L, 128L, 132L, 136L, and 140L, a head pillow 152, and a spine cushion 160. The head pillow 152 is arranged at the top of the inflatable mattress cover 104 and is configured to support the patient's head in a comfortable and safe ergonomic position. The head pillow 152 may be filled with a soft material, for example latex, memory foam, feather, polyester, gel, etc. In some embodiments, the head pillow may be formed as an air chamber and configured to inflate with the other chambers. The head pillow 152 may also include an indented region 180 that serves to support the patient's head and prevent the patient's head from falling to one side during the turning process.

The uppermost right and left chambers 120R, 120L are arranged so as to support the shoulder and arm areas of a patient. The upper edge of the shoulder chambers 120R, 120L may, in some embodiments, have a curved edge 188R, 188L so as to follow the angle of a typical patient's shoulder, with the curved portion terminating at the head pillow 152.

Moving downwardly, the chambers 124R and 124L are arranged so as to support the patient's lower torso and hip region. The torso and hip chambers 124R, 124L may also be configured and arranged so as to provide support for the patient's arm. The chambers 128R, 128L are arranged so as to support the patient's thigh region. At the bottom end of the thigh chambers 128R, 128L, the mattress cover 104 has a crease 192 that enables the mattress cover 104 to be folded at approximately the center of the mattress cover 104.

The spine cushion 160 may be filled with a soft material, for example latex, memory foam, feather, polyester, gel, etc. that enables the spine cushion 160 to comfortably support the spine region of the patient. Alternatively, the spine cushion 160 may be an air chamber that can be selectively filled with air to provide a desired degree of back support to the patient.

Each of the leg chambers 132R and 132L runs along the length of the patient's legs. The leg chambers 132R, 132L may, in some embodiments, be separated from one another by leg barrier chambers 136R, 136L. The leg barrier chambers 136R, 136L serve to prevent the patient's legs from rubbing against one another while the patient is turned to one side. The reader should appreciate, however, that in some embodiments only one leg barrier chamber is included, while in further embodiments the mattress cover does not have leg barrier chambers. The leg chambers 132R, 132L also include one or more creases 196R, 196L located in a patient's knee region so as to enable the mattress cover 104 to bend at the knee region.

The feet cushions 140R, 140L are located at the bottom of the mattress cover 104 so as to align with the foot region of the patient. The feet cushions 140R, 140L may, in some embodiments, be larger than the remaining cushions so that the feet cushions 140R, 140L can inflate to a greater degree than the remaining cushions, thereby elevating the patient's feet.

At the bottom end, the mattress cover 104 includes two pneumatic connectors 200, 204, which connect to the air hoses 112, 116, respectively. The pneumatic connectors may be, for example, quick-connect pneumatic connectors or other suitable pneumatic connectors known in the art.

The mattress cover 104 also includes a plurality of internal air hoses and valves 220 (shown schematically in FIG. 3) that connect the pneumatic connectors 200, 204 to each of the chambers 120R-140R, 120L-140L and, in some embodiments, the head pillow 152 and spine cushion 160. As will be discussed in detail below, the internal air hoses and valves enable the chambers 120R-140R, 120L-140L and, in some embodiments, the head pillow 152 and spine cushion 160 to be selectively inflated and deflated. In addition, in some embodiments, the mattress cover 104 includes at least one pressure sensor 224 (shown schematically in FIG. 3) that enables diagnostics of the air pressure in the chambers to test for leaks, or that is used to determine whether the valves should be opened to allow additional air into any of the chambers. The mattress cover may include a single pressure sensor 224, one pressure sensor in each of the air chambers, or pressure sensors in a selected subset of the chambers.

In addition, the mattress cover 104 may include at least one rapid deflation valve 216, which can be opened to quickly deflate the mattress cover 104. The rapid deflation valve 216 may be, for example, a pull tab that releases all air from device. The rapid deflation valve 216 would be used, for example, when patient needs to be removed from the bed and/or needs immediate staff attention without boundaries so that the mattress will not interfere with the treatment of the patient.

The mattress cover 104 may be made of a suitable biocompatible, strong, and airtight material or combination of materials. For example, the mattress cover 104 may be made of plastic, rubber, composites, polyvinyl chloride (PVC), urethane plastics, or another suitable material that is flexible and airtight. In addition, the mattress cover 104 is waterproof, durable, tear proof, hospital grade, and antifungal. Moreover, in some embodiments, the mattress cover 104 is made of an anti-slip material or has an anti-slip cover or outer layer to prevent the patient from slide along the mattress cover 104 when the mattress cover 104 is inflated.

The air hoses 112, 116 are high pressure hoses capable of withstanding the air pressure necessary to lift the patients. While two air hoses 112, 116 are illustrated, the reader should appreciate that in other embodiments there may be only one air hose, or more than two air hoses. In one particular embodiment, for example if the valves 220 are located in the control unit 108 instead of the mattress cover 104, the patient turning device 100 includes as many air hoses as there are separately controlled chambers in the mattress cover 104. The air hoses may be banded to one another or restrained within a sleeve so that the air hoses do not interfere with the portability of the patient turning device 100. In some embodiments, the air hoses 112, 116 are bundled with electrical wires so as to enable the control unit 108 to communicate with the valves 220 and pressure sensors 224 therein.

Figure 3:
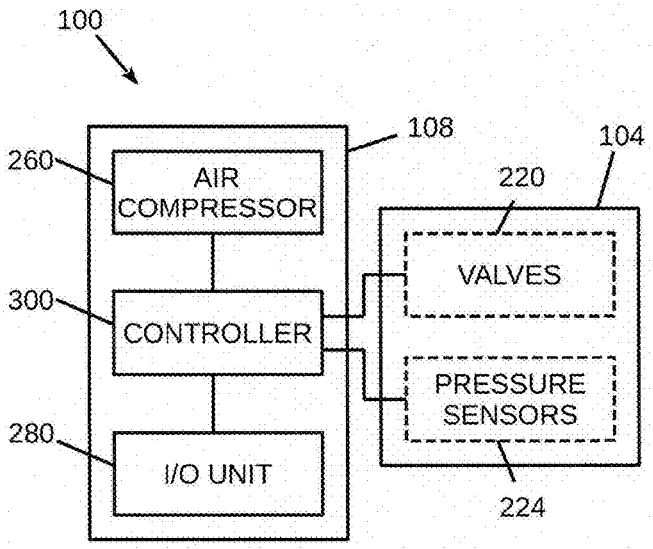
FIG. 3 is a schematic diagram of the controller and control connections of the patient turning device of FIG. 1.

FIG. 2 illustrates the control unit 108 of the portable patient turning device 100, while FIG. 3 schematically depicts the control connections of the portable patient turning device 100. The control unit 108 includes a housing 240 that has a handle 244. The handle 244 is thick so as to enable the control unit 108 to be easily carried by a caregiver or by the patient. The housing 240 also includes two hose connectors 252, 256, which connect to the air hoses 112, 116, respectively, that are connected to the mattress cover 104. In addition, in some embodiments, the housing 240 may include anti-slip plugs or feet on the bottom of the housing to prevent the control unit 108 from sliding across the floor or table on which the control unit 108 is positioned.

The control unit 108 further includes an air compressor 260 arranged within and supported by the housing 240. The output of the air compressor 260 is fluidly connected to the hose connectors 252, 256 so that the compressed air from the compressor outlet is transferred to the mattress cover 104 via the air hoses 112, 116.

The control unit 108 also has a power button 276 and an input/output unit 280. The power button 276 operates to activate and deactivate the control unit 108 via, for example, enabling and disabling an electrical connection to a battery (not shown) contained within the housing 240 or to an electrical plug (not shown) that can be connected to a mains power supply. The input/output unit 280 provides information to the caregiver or patient and has an interface that the caregiver or patient may use to operate the portable patient turning device 100. The input/output unit 280 may include, for example, one or more of a touchscreen display, an output display, and a plurality of buttons, knobs, etc.

Operation and control of the various subsystems, components and functions of the portable patient turning device 100 described herein are performed with the aid of a controller 300. As depicted in FIG. 3, the controller 300 is operably connected to the electronic components of the portable patient turning device 100, for example the air compressor 260, the input/output unit 280, and, optionally, the valves 220 and pressure sensors 224. The controller 300 is implemented with a general or specialized programmable processor that executes programmed instructions. In some embodiments, the controller includes more than one general or specialized programmable processor. The instructions and data required to perform the programmed functions are stored in a memory unit associated with the controller. The processor, memory, and interface circuitry configure the controller 300 to perform the functions disclosed above and the processes described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

Figure 4:
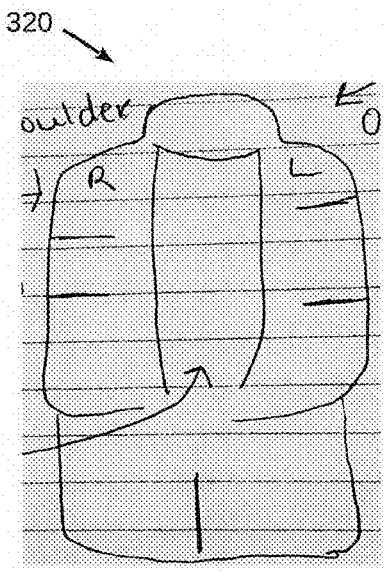
FIG. 4 is an illustration of a user interface of the control unit of FIG. 2.

FIG. 4 illustrates an example user interface 320 that may be included in the input/output unit 280. The user interface 320 may be implemented as a graphical user interface in a touchscreen display, or it may be an input interface with a plurality of physical buttons and knobs. The user interface 320 depicts an image of the mattress cover 100 divided into sections illustrating specific areas that the patient may want to target for specific care. In particular, in some embodiments, the user interface may include one section for each of the inflatable chambers 120R-140R, 120L-140L, 152, and 160. After one section of the user interface 320 is pressed, the controller 300 is configured to activate the air compressor 260 and the necessary valves 220 to inflate the chamber selected by the caregiver or patient. For example, if patient is concerned about his or her right shoulder, the user clicks on the image of the right shoulder of the user interface 320, and the controller 300 then operates the air compressor 260 to activate and operates the valves 220 connecting the air compressor 260 to the chamber 120R to inflate the chamber 120R.

The user interface may also include options to automatically turn the patient. The user may select a turn to the left or a turn to the right. When the user selects the option to turn to the left, the controller 300 activates the air compressor 260 and opens the valves 220 connecting the air compressor 260 to the right side chambers 120R-140R, thereby inflating the right side of the mattress cover 104. When the right side of the mattress cover 104 is inflated, the patient is rolled to his or her left, thereby executing the patient turn to the left. Conversely, to execute a turn to the right, the controller 300 opens the valves 220 connecting the air compressor 260 to the left side chambers 120L-140L, thereby inflating the left side chambers and turning the patient to the right. In addition, the user interface includes options for automatically executing turns at desired intervals. For example, the user may select the option for an automatic turn every 30 minutes, 1 hour, 2 hours, every 4 hours, every 6 hours, every 8 hours, etc.

During a turning process, the controller 300 may be configured to operate the valves 226 to inflate one or both of the leg barrier chambers 136R, 136L to provide a barrier between the patient's legs. With the leg barrier chambers 136R, 136L inflated, the patient's legs cannot rub together and cause friction and/or discomfort. The input/output unit 280 also has an option for the user to disable the leg barrier inflation during turning processes based on the patient's preference.

The controller 300 may also, in some embodiments, be configured to detect an air leak in the mattress cover 104. The controller 300 monitors the pressure sensors 224 and, when one of the pressure sensors 224 indicates that the pressure is decreasing when it should not be decreasing, the controller 300 activates an alarm via the input/output unit 280. The alarm may be, for example, a visual alert or an audio alert. The I/O unit 280 may alternately consist of a tablet that wirelessly communicates with the controller 200 and air compressor 260 to effect turning of a patient.

Since the control unit 108 has a relatively small housing 240 and a handle 244, and the mattress cover 104 can be deflated and folded, the portable patient turning device 100 is easily portable. As a result, the patient does not have to wait for a special turning bed to be moved into the patient's room when necessary. In addition, the portable patient turning device 100 can be stored in a closet at a hospital or a patient's home when not in use. Moreover, a patient can easily pack the portable patient turning device 100 for travel.

In addition, the portable patient turning device 100 is inexpensive and can be used with many or all existing beds. A patient therefore does not have to buy an expensive bed for automatic turning at home. The portable patient turning device 100 therefore allows families who have members that are paralyzed or bed bound (and therefore at high risk of pressure sores) to travel without fear of having to make special hotel accommodations for the family member. The family member can use the portable patient turning device 100 anywhere and be confident that the patient is being turned at satisfactory intervals. Accordingly, the portable patient turning device 100 can provide ease of mind for the patient and his or her family.

The portable patient turning device 100 is formed of materials that are durable, thereby enabling the portable patient turning device 100 to last for years. Consequently, hospitals and patients using the device 100 at home can provide automatic turning of patients in a cost effective manner.

Additionally, since the portable patient turning device 100 automatically turns the patient, the physical stress put on caregivers is reduced or eliminated. Moreover, the automatic turning occurs quietly, thereby allowing the patient to continue resting and healing while being safe from the possibility of pressure sores.

The head cushion 152 of the portable patient turning device 100 helps to keep the patient's head from falling to the side. In particular with paralyzed patients, a patient can suffocate if the patient's head turns to the side. Since the head cushion 152 prevents the patient's head from inadvertently turning to the side, the portable patient turning device 100 reduces the risk of a paralyzed patient from suffocating while being turned.

Figure 5:
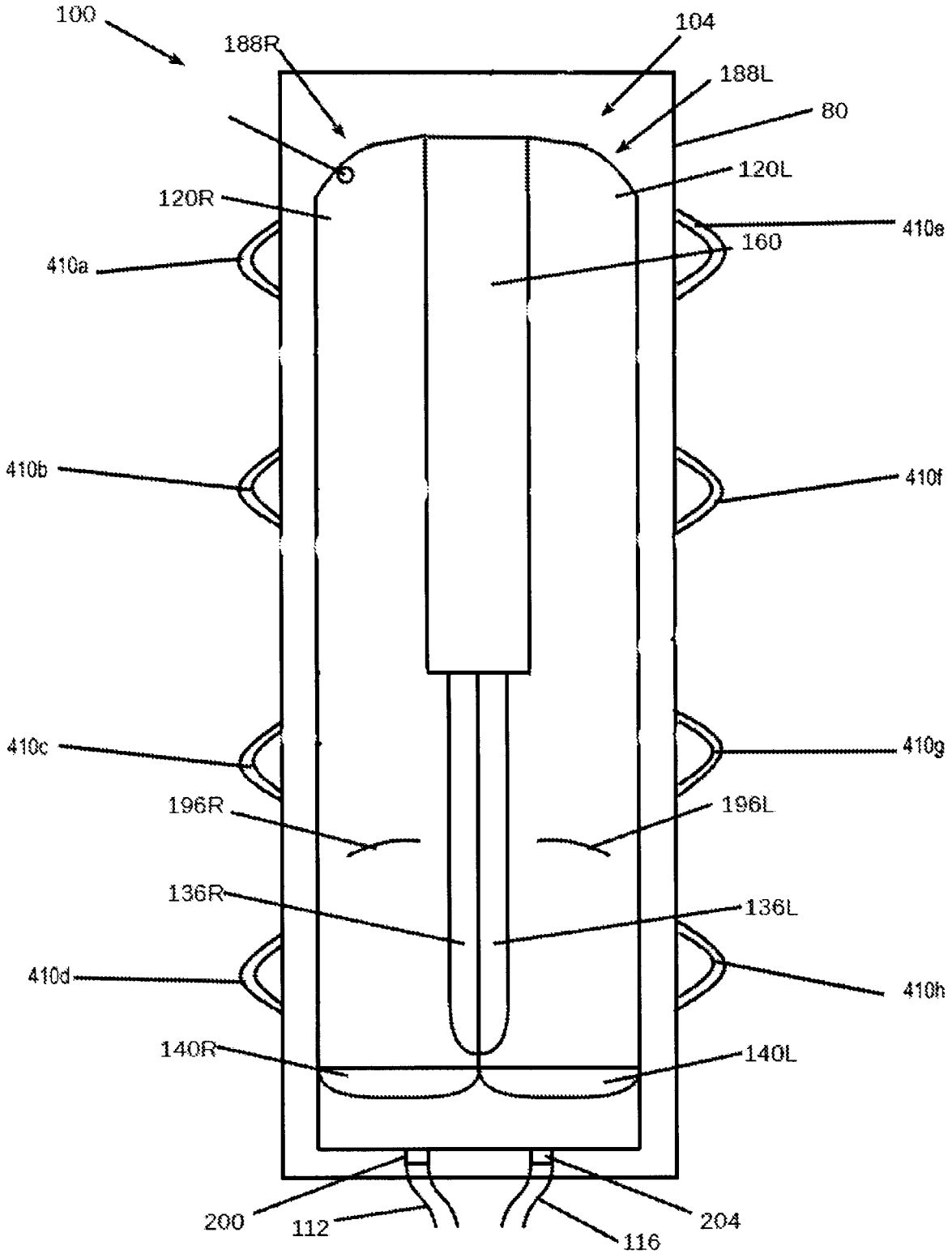
FIG. 5 is a top plan view of an inflatable mattress pad of a patient turning device according to an alternate preferred embodiment of the invention.

FIG. 5 depicts an inflatable mattress cover 104 of a patient turning device 100 according to an alternate preferred embodiment of the invention. The device shown in FIG. 5 is similar to the device shown in FIG. 1 wherein like reference numbers indicate like component parts. However, the inflatable mattress pad of FIG. 5 does not include a head cushion 152. In addition, instead of the four chambers on each side shown in FIG. 1, the device shown in FIG. 5 includes a single right side inflatable chamber 120R and a single left side inflatable chamber 120L that essentially span the length of the patient's body. The inflatable mattress cover 104 may also include a plurality of handles 410*a*, 410*b*, 410*c*, 410*d*, 410*e*, 410*f*, 410*g*, 410*h* along the long edges of the cover 104 to facilitate positioning of the cover 104 on the bed, turning of the patient, and transfer of the patient from a stretcher to or from a bed if needed. While FIG. 5 depicts four handles on each lateral side of the cover 104, any number of handles can be used. Further, straps may be provided on the underside of the cover 104 to removably secure the cover to the bed.

It will be appreciated that variants of the above-described and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the foregoing disclosure.

I claim:

1. A portable patient turning device removably attached to a bed, comprising:

an inflatable mattress cover having a planar surface configured to substantially cover the surface of a bed, said inflatable mattress cover further comprising a first inflatable chamber proximate to and extending along a left edge of the planar surface, a second inflatable chamber proximate to and extending along a right edge of the planar surface, and a spine cushion positioned between the first inflatable chamber and the second inflatable chamber and extending along a middle portion of the planar surface for at least a portion of the length of the first inflatable chamber and second inflatable chamber, wherein said first inflatable chamber and said second inflatable chamber extend inwardly toward and to a point of contact with lateral edges of the spine cushion such that said first inflatable chamber and said second inflatable chamber are positioned under a patient; and a control unit connected to said inflatable mattress cover by one or more air hoses, said control unit including a user interface, said user interface including means for selecting an interval for automatically inflating/deflating selected inflatable chambers to turn the patient at said selected interval.

2. The portable patient turning device of claim 1 wherein said control unit is connected to the first inflatable chamber by a first air hose and said control unit is connected to the second inflatable chamber by a second air hose.

3. The portable patient turning device according to claim 1 wherein said first inflatable chamber and said second inflatable chamber are each divided into a plurality of subchambers.

4. The portable patient turning device according to claim 3, wherein said plurality of subchambers include a left leg subchamber and a right leg subchamber extending along a lower region of the inflatable mattress cover.

5. The portable patient turning device according to claim 4 further comprising a leg barrier chamber positioned between and extending the length of the left and right leg subchambers, said leg barrier chamber projecting a height above the planar surface that exceeds the height of the left and right leg subchambers.

6. The portable patient turning device according to claim 5, wherein said leg barrier chamber comprises a left leg barrier chamber and a separate right leg barrier chamber.

7. The portable patient turning device according to claim 4, further comprising one or more creases located in a central region of each of said left and right leg subchambers in a patient's knee region.

8. The portable patient turning device according to claim 4 wherein the mattress cover comprises a crease extending from the right edge of the planar surface to the left edge of the planar surface between and upper edge of the right and left leg subchambers and a lower edge of one or more upper right and left inflatable chambers.

9. The portable patient turning device according to claim 4 wherein the plurality of subchambers further include a plurality of left upper subchambers and a plurality of right upper subchambers extending along an upper region of the inflatable mattress cover.

10. The portable patient turning device according to claim 9 wherein said plurality of left and right upper subchambers each comprises a first upper subchamber in a patient's shoulder and arm region, a second upper subchamber in the patient's lower torso and hip region, and a third upper subchamber in the patient's thigh region.

11. The portable patient turning device according to claim 4 further comprising a left foot cushion and a right foot cushion located at the bottom of the mattress cover in a patient's foot region.

12. The portable patient turning device according to claim 11 wherein the left foot cushion and the right foot cushion are larger than the plurality of subchambers.

13. The portable patient turning device according to claim 1, further comprising a head pillow proximate to a top edge of the planar surface in a patient's head region.

14. The portable patient turning device according to claim 13, wherein the head pillow is filled with a soft material selected from the group consisting of latex, memory foam, feather, polyester, and gel.

15. The portable patient turning device according to claim 13, wherein the head pillow includes an indented region in a central region of an upper surface.

16. The portable patient turning device according to claim 3, wherein the mattress cover further comprises a plurality of internal air hoses and valves positioned between the plurality of subchambers for separately and independently delivering air to each individual subchamber for selective inflation and deflation.

17. The portable patient turning device according to claim 16 further comprising at least one pressure sensor located in the mattress cover.

18. The portable patient turning device according to claim 1 further comprising a plurality of handles along the left edge of the mattress cover and a plurality of handles along the right edge of the mattress cover.

19. The portable patient turning device according to claim 1 wherein said means for selecting an interval for automatically inflating/deflating selected inflatable chambers alternates inflation of the first inflatable chamber and the second inflatable chamber.

* * * * *